US008186418B2

(12) United States Patent
Liu et al.

(10) Patent No.: US 8,186,418 B2
(45) Date of Patent: May 29, 2012

(54) UNIDIRECTIONAL SOLIDIFICATION PROCESS AND APPARATUS THEREFOR

(75) Inventors: Shan Liu, Central, SC (US); Jon Conrad Schaeffer, Simpsonville, SC (US); Ganjiang Feng, Greenville, SC (US); Stephen Joseph Balsone, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/894,998

(22) Filed: Sep. 30, 2010

(65) Prior Publication Data

US 2012/0080158 A1 Apr. 5, 2012

(51) Int. Cl.
*B22D 27/00* (2006.01)
*B22D 25/00* (2006.01)
*B22D 27/04* (2006.01)

(52) U.S. Cl. ..... 164/122.1; 164/122.2; 164/338.1

(58) Field of Classification Search ..... 164/122.1, 164/122.2, 338.1; 148/404
See application file for complete search history.

(56) References Cited

U.S. PATENT DOCUMENTS 3,897,815 A * 8/1975 Smashey ..... 164/127
4,202,400 A 5/1980 Gigliotti, Jr. et al.

* cited by examiner

*Primary Examiner* — Jessica L Ward
*Assistant Examiner* — Steven Ha
(74) *Attorney, Agent, or Firm* — Ernest G. Cusick; Gary M. Hartman; Domenica N. S. Hartman

(57) ABSTRACT

An apparatus and method for casting an alloy using a unidirectional casting technique. The apparatus includes a mold adapted to contain a molten quantity of an alloy, a primary heating zone adapted to heat the mold and the molten alloy therein to a temperature above the liquidus temperature of the alloy, a cooling zone adapted to cool the mold and molten alloy therein to a temperature below the solidus temperature of the alloy and thereby yield the unidirectionally-solidified casting, and an insulation zone between the primary heating zone and the cooling zone. The apparatus also has a secondary heating zone separated from the insulation zone by the primary heating zone. The secondary heating zone maintains the mold and the molten alloy therein at a temperature below the liquidus temperature of the alloy. The temperatures within the primary and secondary heating zones are individually set and controlled.

5 Claims, 2 Drawing Sheets

PRIOR ART

UNIDIRECTIONAL SOLIDIFICATION PROCESS AND APPARATUS THEREFOR

BACKGROUND OF THE INVENTION

The present invention generally relates to materials and processes for producing directionally-solidified castings, and particularly to a process and apparatus capable of reducing defects in alloys cast as long single-crystal (SX) and directionally-solidified (DS) articles, including but not limited to components of gas turbines and other high temperature applications.

Components of gas turbines, such as blades (buckets), vanes (nozzles) and combustor components, are typically formed of nickel, cobalt or iron-base superalloys characterized by desirable mechanical properties at turbine operating temperatures. Because the efficiency of a gas turbine is dependent on its operating temperatures, there is an ongoing effort to develop components, and particularly turbine buckets, nozzles, and combustor components, that are capable of withstanding higher temperatures. As the material requirements for gas turbine components have increased, various processing methods and alloying constituents have been used to enhance the mechanical, physical and environmental properties of components formed from superalloys. For example, buckets, nozzles and other components employed in demanding applications are often cast by unidirectional casting techniques to have directionally-solidified (DS) or single-crystal (SX) microstructures, characterized by an optimized crystal orientation along the crystal growth direction to produce columnar polycrystalline or single-crystal articles.

As known in the art, directional casting techniques for producing SX and DS castings generally entail pouring a melt of the desired alloy into an investment mold held at a temperature above the liquidus temperature of the alloy. One such process is represented in FIGS. 1 and 2 as an apparatus 10 that employs a Bridgman-type furnace to create a heating zone 26 surrounding a shell mold 12, and a cooling zone 42 beneath the mold 12. The zones 26 and 42 may be referred to as "hot" and "cold" zones, respectively, which as used herein denotes their temperatures relative to the melting temperature of the alloy being solidified. The mold 12 has an internal cavity 14 corresponding to the desired shape of a casting 32 (FIG. 2), represented as a turbine bucket. As such, FIG. 1 represents the cavity 14 as having regions 14*a*, 14*b* and 14*c* that are configured to form, respectively, an airfoil portion 34, shank 36, and dovetail 38 (FIG. 2) of the casting 32. The cavity 14 may also contain cores (not shown) for the purpose of forming cooling passages within the casting 32. The mold 12 is shown secured to a chill plate 24 and placed in the heating zone 26 (Bridgman furnace). The heating zone 26 heats the mold 12 to a temperature above the liquidus temperature of the alloy. The cooling zone 42 is directly beneath the heating zone 26, and operates to cool the mold 12 and the molten alloy 16 within by conduction, convection and/or radiation techniques. For example, the cooling zone 42 may be a tank containing a liquid cooling bath 46, such as a molten metal, or a radiation cooling tank that may be evacuated or contain a gas at ambient or cooled temperature. The cooling zone 42 may also employ gas impingement cooling or a fluidized bed.

An insulation zone 44 defined by a baffle, heat shield or other suitable means is between and separates the heating and cooling zones 26 and 42. The insulation zone 44 serves as a barrier to thermal radiation emitted by the heating zone 26, thereby promoting a steep axial thermal gradient between the mold 12 and the cooling bath 46. The insulation zone 44 has a variable-sized opening 48 that, as represented in FIG. 1, enables the insulation zone 44 to fit closely around the shape of the mold 12 as it is withdrawn from the heating zone 26, through the insulation zone 44, and into the liquid cooling bath 46.

Casting processes of the type represented in FIGS. 1 and 2 are typically carried out in a vacuum or an inert atmosphere. After the mold 12 is preheated to a temperature above the liquidus temperature of the alloy being cast, molten alloy 16 is poured into the mold 12 and the unidirectional solidification process is initiated by withdrawing the base of the mold 12 and chill plate 24 downwardly at a fixed withdrawal rate into the cooling zone 42, until the mold 12 is entirely within the cooling zone 42 as represented in FIG. 2. The insulation zone 44 is required to maintain the high thermal gradient at the solidification front to prevent nucleation of new grains during the directional solidification processes. The temperature of the chill plate 24 is preferably maintained at or near the temperature of the cooling zone 42, such that dendritic growth begins at the lower end of the mold 12 and the solidification front travels upward through the mold 12. The casting 32 grows epitaxially from a small block 28 at the bottom of the mold 12. The block 28 may be, for example, a cylindrical chill block or a conical seed piece from which a single crystal forms from a crystal selector 30, for example, a pigtail sorting structure. The columnar single crystal becomes larger in the enlarged section of the cavity 14. A bridge 40 connects protruding sections of the casting 32 with lower sections of the casting 32 so that a unidirectional columnar single crystal forms substantially throughout the casting 32. The casting 32 is typically deemed to be a substantially columnar single crystal if it does not have high angle grain boundaries, for example, greater than about twenty degrees.

Mechanical properties of DS and SX articles depend in part on the avoidance of high-angle grain boundaries, equiaxed grains, and other potential defects that may occur as a result of the directional solidification process. As an example, small dendrite arm spacing is usually desired to avoid casting defects such as stray grains, slivers and freckles, and to improve the uniformity of strengthening phases and improve mechanical properties at service temperatures of the article. A small dendrite spacing can be effectively obtained by a steep thermal gradient at the growth interface during directional solidification. In a conventional Bridgman apparatus, the temperature of the heating zone 26 is generally maintained at a temperature of about 300 to about 400° F. (about 160 to about 220° C.) above the liquidus temperature of the alloy in order to obtain a sufficiently high thermal gradient. However, detrimental effects can inevitably occur if the shell mold 12 is held at an excessively high temperature within the heating zone 26 for an extended period of time. Such dimensional defects may result from creep movement and deformation of the mold 12 and any cores used in the casting process, and surface finish defects resulting from interactions between the molten alloy 16 and the mold 12 and cores. Such interactions are particularly possible if the alloy contains elements that are reactive at high temperatures ("reactive elements"), such as yttrium, zirconium and hathium, and to a lesser extent other elements such as tantalum, tungsten, rhenium, and titanium, which are also often referred to as being reactive. Because superalloys typically contain reactive elements, a common practice is to protect the surface of the mold 12, which is typically formed of a refractory material such as alumina or silica, with a facecoat, a nonlimiting example of which contains yttria ($Y_2O_3$). While effective in reducing reactions with many alloy compositions, protective facecoats do not address other potential defects that may occur during the solidification process, including dimensional defects resulting from extended stays at excessive temperatures.

BRIEF DESCRIPTION OF THE INVENTION

The present invention provides an apparatus and method for casting an alloy using a unidirectional casting technique to produce a casting having a directionally-solidified (DS) or single-crystal (SX) microstructure.

According to a first aspect of the invention, the apparatus includes a mold having a mold cavity adapted to contain a molten quantity of an alloy during solidification thereof to yield a unidirectionally-solidified casting defined by the mold cavity. The apparatus further includes a primary heating zone adapted to heat the mold and the molten quantity of the alloy therein to a primary heating temperature above the liquidus temperature of the alloy, a cooling zone adapted to cool the mold and the molten quantity of the alloy therein to a cooling temperature below the solidus temperature of the alloy and thereby yield the unidirectionally-solidified casting, and an insulation zone between the primary heating zone and the cooling zone. The insulation zone is adapted to define a thermal gradient therein to promote unidirectional solidification of the molten quantity of the alloy. The apparatus also has a secondary heating zone separated from the insulation zone by the primary heating zone. The secondary heating zone is adapted to attain within the mold a secondary heating temperature that is lower than the primary heating temperature of the primary heating zone yet sufficiently close to the liquidus temperature of the alloy so that the molten quantity of the alloy will contain both solid and liquid phases while at the secondary heating temperature. Finally, the apparatus includes means for causing relative movement between the mold and the primary heating, cooling and insulation zones in a first direction of the apparatus so as to sequentially subject the mold and the molten alloy therein to the primary heating zone, the insulation zone, and then the cooling zone, and a temperature control means for individually setting and controlling the primary and secondary heating temperatures within the primary and secondary heating zones and maintain the secondary heating temperature at a level less than the primary heating temperature.

According to a second aspect of the invention, a casting method is provided that utilizes the apparatus described above to cast the alloy.

According to another aspect of the invention, a particular method of casting an alloy includes pouring a molten quantity of an alloy into a cavity of a mold while at least a portion of the mold is located within a secondary heating zone of an apparatus. The secondary heating zone causes the molten quantity of the alloy located within the secondary heating zone to be at a secondary heating temperature that is below the liquidus temperature of the alloy yet sufficiently close to the liquidus temperature of the alloy so that the molten quantity of the alloy will contain both solid and liquid phases while within the secondary heating zone. Relative movement between the mold and the apparatus then causes the mold to be translated from the secondary heating zone through a primary heating zone of the apparatus. The primary heating zone heats the molten quantity of the alloy located within the primary heating zone to a primary heating temperature above the liquidus temperature of the alloy, melts the solid phase within the molten quantity of the alloy, and causes the molten quantity of the alloy located within the primary heating zone to contain only liquid phase. Further relative movement between the mold and the apparatus causes the mold to be translated from the primary heating zone through an insulation zone of the apparatus and into a cooling zone of the apparatus. The insulation zone creates a thermal gradient within the molten quantity of the alloy located within the insulation zone to cause unidirectional solidification of the molten quantity of the alloy entering the cooling zone. The mold is then cooled to produce a unidirectionally-solidified casting and a columnar crystal structure therein.

According to preferred aspects of the invention, the apparatus and methods of this invention can be employed to promote the mechanical properties of a casting, and particularly DS and SX castings, that depend in part on the avoidance of potential defects that can occur during a unidirectional solidification process due to excessively high temperatures within the heating zone. The apparatus and method are also capable of promoting the dimensional and metallurgical quality of a casting, and reducing the power consumption of the solidification process. Nonlimiting examples of castings that can benefit from this invention include components of gas turbines, such as shrouds, buckets, blades, and nozzles.

Other aspects and advantages of this invention will be better appreciated from the following detailed description.

DETAILED DESCRIPTION OF THE INVENTION

The present invention can be employed to produce various castings from a wide variety of alloys, including but not limited to nickel-base, cobalt-base and iron-base superalloy. Certain capabilities of the invention are particularly well suited for producing elongate articles having tight dimensional quality requirements and/or alloys that contain levels of reactive elements above incidental or trace amounts that may otherwise be present. Most notably, an alloy may contain yttrium, zirconium and/or hafnium at levels that render it reactive to oxygen and/or the surface of a mold or core while the alloy is in a molten state. Other elements of potential concern include tantalum, tungsten, rhenium, and titanium. These elements are commonly found in alloys used to produce cast articles suitable for such applications as the hot gas flow path components of a gas turbine, including but not limited to buckets and nozzles of land-based gas turbines, blades and vanes of aircraft gas turbines, as well as shrouds found in both types of gas turbines. To promote their high temperature properties, these components are often unidirectionally cast to have a columnar single crystal (SX) or columnar polycrystalline directionally-solidified (DS) microstructure. While the advantages of this invention will be described with reference to components of a gas turbine, the teachings of this invention are generally applicable to other components that may benefit from being unidirectionally cast.

A DS or SX casting is produced from a melt of the desired alloy, for example, prepared by known vacuum induction melting techniques. As known in the art, heat transfer conditions during the solidification of the casting are controlled so that the solidification front advances unidirectionally and steadily to generate primary columnar crystals/grains, and to avoid the nucleation and formation of secondary grains from the melt in competition with the primary columnar single crystal. The present invention proposes additional steps to promote the mechanical, dimensional and metallurgical properties of a casting beyond what can ordinarily be achieved with conventional unidirectional casting techniques.

Figure 2:
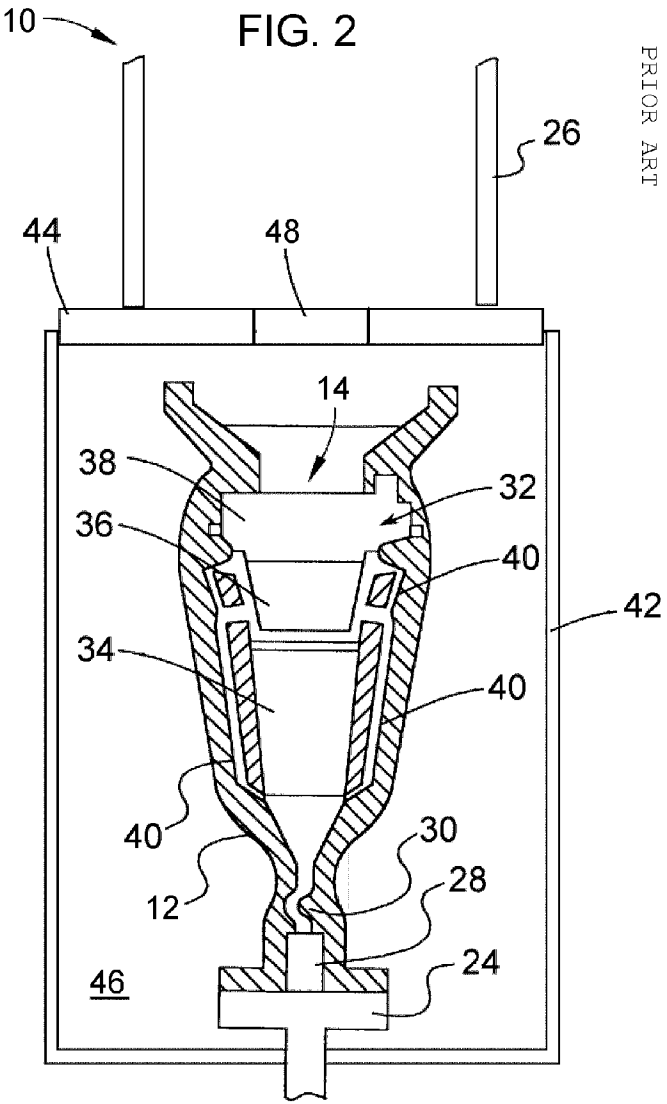
FIGS. 1 and 2 represent sectional views showing two steps of a unidirectional casting (solidification) process to produce a single-crystal turbine blade in accordance with the prior art.
Figure 1:
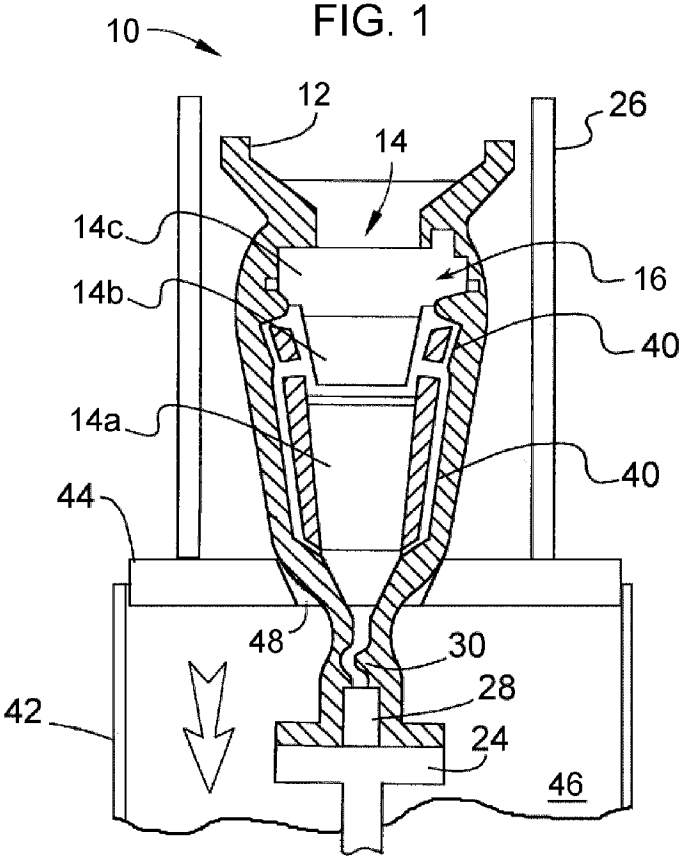
FIG. 1 PRIOR ART
Figure 3:
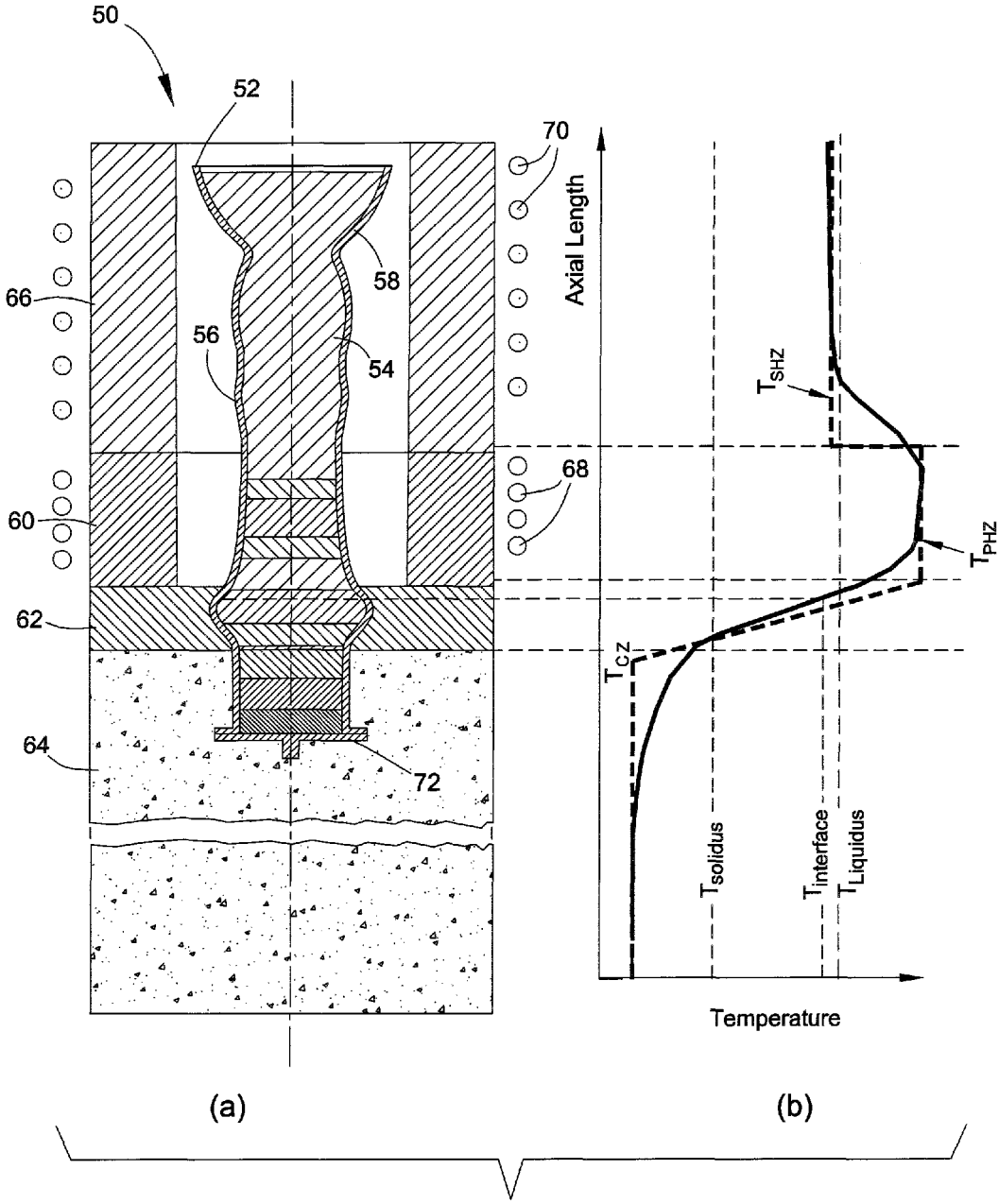
FIG. 3 schematically represents (a) a cross-sectional view showing an apparatus capable of performing a unidirectional solidification process in accordance with an embodiment of this invention, and further includes (b) a graph indicating relative temperatures within the apparatus.

FIG. 3(*a*) schematically represents an apparatus 50 adapted to carry out a unidirectional casting technique in accordance with an embodiment of the invention. The apparatus 50 is represented as including a shell mold 52 of a type suitable for producing a DS or SX casting. As known in the art, the mold 52 may be formed of a material such as alumina or silica, and has an internal cavity 54 corresponding to the desired shape of a casting (not shown) to be formed from a molten alloy 56 within the cavity 54. It should be understood that complicated cores may be positioned within the mold cavity 54 to form internal passages/features in the casting. The mold 52 is represented as including a riser 58, through which a melt of the desired alloy is introduced into the mold 52. As known in the art, liquid metal can also be introduced into the mold cavity 54 through a gating system (not shown), in which case the riser 58 may simply serve to feed the solidification shrinkage of the casting. The mold 52 is secured to a chill plate 72, similar to what is represented in FIGS. 1 and 2. Because of additional similarities between the apparatus 50 of FIG. 3(*a*) and the conventional apparatus 10 depicted in FIGS. 1 and 2, the following discussion of FIG. 3(*a*) will focus primarily on aspects of the apparatus 50 that differ from the apparatus 10 of FIGS. 1 and 2 in some notable or significant manner. Other aspects of the apparatus 50 of FIG. 3(*a*) not discussed in any detail can be, in terms of structure, function, materials, etc., essentially as was described for the apparatus 10 of FIGS. 1 and 2.

As with the apparatus 10 and process represented in FIGS. 1 and 2, casting processes performed with the apparatus 50 of FIG. 3(*a*) are preferably carried out in a vacuum or an inert atmosphere. The mold 52 is preferably preheated prior to introducing the melt of the desired alloy through the riser 58 (or a separate gating system). The mold 52 then passes through a heating zone 60 where the mold 52 is heated to a temperature equal to or above the melting temperature of the alloy, and more particularly above the liquidus temperature of the alloy, after which unidirectional solidification is initiated by withdrawing the chill plate 72 and the base of the mold 52 downwardly at a fixed rate through an insulation zone 62 where solidification is initiated, and then into a cooling zone 64 where solidification is completed. Because of the temperature gradient between the heating zone 60 and the cooling zone 64, a range of temperatures will exist within the alloy, as schematically depicted by the different cross-hatching used to represent the alloy 56 within the cavity 54 in FIG. 3(*a*). The cooling zone 64 may contain a liquid metal cooling bath, or a vacuum or ambient or cooled air for radiation cooling. Depending on particular conditions, unidirectional columnar crystals (DS) form or a single unidirectional columnar crystal (SX) forms substantially throughout the casting. For example, an SX casting within the mold 52 can be caused to grow epitaxially (for example, with the <100> orientation) based on the crystalline structure and orientation of a small block of single-crystal seed material (not shown) at the base of the mold 52, from which a single crystal forms from a crystal selector (not shown). A DS casting can be produced in a similar manner, though with modifications to the mold 52, such a growth zone at the base of the mold 52 that is open to the chill plate 72, and omission of the crystal selector.

As evident from FIG. 3(*a*), the apparatus 50 differs from the apparatus 10 of FIGS. 1 and 2 in part by the inclusion of a secondary heating zone 66 located at the entrance to the heating zone 60, which for convenience will now be referred to as the primary heating zone 60 of the apparatus 50. The apparatus 50 is configured to maintain the primary function of the heating zone within a traditional Bridgman furnace (such as the heating zone 26 of the apparatus 10 of FIGS. 1 and 2), while minimizing and potentially eliminating certain deleterious effects that can occur within the heating zone of conventional Bridgman furnaces. Specifically, the primary and secondary heating zones 60 and 66 provide two discrete hot zones within the apparatus 50, as compared to the single and continuous heating zone 26 of FIGS. 1 and 2. An important difference between the primary and secondary heating zones 60 and 66 is that the temperatures within these zones 60 and 66 are different and independently controlled. The temperature within the primary heating zone 60 is preferably selected and controlled at a level that would be conventional for the traditional Bridgman apparatus 10 of FIGS. 1 and 2, namely, a temperature above and preferably much higher (for example, about 160 to about 220° C. higher) than the liquidus temperature of the alloy being cast. The temperature within the primary heating zone 60 determines the axial thermal gradient through the insulation zone 62, where solidification is initiated as mentioned above.

In contrast, the temperature within the secondary heating zone 66 is intentionally selected and controlled to be lower than that of the primary heating zone 60, though higher than the solidus temperature of the alloy. More preferably, the temperature of the molten alloy 56 within the secondary heating zone 66 is below but near the liquidus temperature of the alloy. For example, calculated on the basis of the temperature difference ($\Delta T$) between the liquidus and solidus temperatures ($T_{liquidus}$ and $T_{solidus}$) of the alloy, the temperature ($T_{SHZ}$) within the secondary heating zone 66 may be within about ten percent or less of the liquidus temperature ($(T_{liquidus}-0.1\ \Delta T) \leqq T_{SHZ} < T_{liquidus}$), and more preferably is within a few degrees centigrade of the liquidus temperature, for example, within 10° C. or perhaps within 5° C. of the liquidus temperature. Consequently, the temperature within the secondary heating zone 66 is controlled to maintain the alloy 56 between the solidus and liquidus temperatures of an alloy, known as the "mushy" zone, and therefore the molten alloy 56 within the secondary heating zone 66 is characterized by a liquid phase that contains a minor amount of solid phase. The relevant amounts of the solid and liquid phases will depend on how close the temperature is to the liquidus temperature.

For unidirectionally solidifying castings of a particular size, the primary and secondary heating zones 60 and 66 can occupy the same volume or axial length of the apparatus 50 as would be occupied by the single heating zone 26 of FIGS. 1 and 2. In other words, the combined size of the heating zones 60 and 66 of FIG. 3(*a*) is not necessarily larger than the heating zone 26 of FIGS. 1 and 2. Notably, the primary heating zone 60 is shown in FIG. 3(*a*) as much shorter in the axial direction of the apparatus 50 than the secondary heating zone 66. This aspect of the apparatus 50 is to significantly reduce the contact time between hot liquid alloy 56 and the mold 52 (and any cores) and thus to minimize deleterious effects that would result from surface reactions and shell/core creep.

FIG. 3(*b*) contains a graph that is associated with the representation of the apparatus 50 to indicate temperature settings (dashed lines) for the primary and secondary heating zones 60 and 66 and the cooling zone 64. Due to convective and/or diffusive heat transfer within the heating zones 60 and 66, insulation zone 62, and cooling zone 64, the actual temperature profile within the alloy melt and resulting casting will be more gradual, as indicated by the continuous solid line in FIG. 3(*b*). The abbreviations $T_{SHZ}$, $T_{PHZ}$ and $T_{CZ}$ are used in FIG. 3(*b*) to represent the set temperatures for the secondary heating zone 66, primary heating zone 60, and cooling zone 64, respectively, and the abbreviations $T_{solidus}$ and $T_{liquidus}$ are used in FIG. 3(*b*) to represent the solidus and liquidus temperatures, respectively, of the alloy. The location and temperature of the solidification front or interface are also represented in the molten alloy 56 and graph of FIGS. 3(*a*) and 3(*b*). From FIGS. 3(*a*) and 3(*b*), it should be apparent that a primary heating temperature, secondary heating temperature, and cooling temperature may be said to exist within the primary heating zone 60, secondary heating zone 66, and cooling zone 64, respectively, though these temperatures do not necessarily refer to specific or uniform temperatures, but instead can refer to ranges of temperatures that differ from each other, for example, a range of temperatures that will likely exist within the molten alloy 56 while within the secondary heating zone 66, a higher range of temperatures that will likely exist within the molten alloy 56 while within the primary heating zone 60, and a lower range of temperatures that will likely exist within the resulting casting during and following solidification of the alloy within the cooling zone 64.

From the graph, it is evident that, whereas the set temperature ($T_{SHZ}$) and the actual temperature of the molten alloy within the secondary heating zone 66 are slightly below $T_{liquidus}$, the set temperature ($T_{PHZ}$) and the actual temperature of the molten alloy 56 within the primary heating zone 60 are well above $T_{liquidus}$, enabling a steep thermal gradient within the insulation zone 62. In particular, the temperature difference between the actual temperatures within the primary heating zone 60 and cooling zone 64 and the thickness of the baffle or heat shield that defines the insulation zone 62 therebetween determine the temperature gradient at the solidification interface within the insulation zone 62. Accordingly, for a given unidirectional solidification process, if the temperature of the cooling zone 64 and the thickness of the insulation zone 62 remain unchanged, the axial thermal gradient within the insulation zone 62 will be determined solely by the heating zone 60, and the inclusion of the secondary heating zone 66 will not alter the axial thermal gradient. This aspect of the invention allows the length of the secondary heating zone 66 to be significantly longer than the primary heating zone 60 (as represented in FIG. 3(*a*)), potentially providing for considerable energy savings to operate the apparatus 50 without degrading or otherwise altering the thermal gradient at the solid/liquid interface within the insulation zone 62.

Depending on the relevant temperature range and type of atmosphere used in the process performed with the apparatus 50, the primary and secondary heating zones 60 and 66 may employ the same or different types of heating elements 68 and 70, respectively. For example, Ni—Cr wires, SiC rods/tubes, Pt—Rh wires and $MoSi_2$ heating elements can be used to achieve temperatures of up to about 1000° C., about 1400° C., about 1500° C. and about 1700° C., respectively, in air. Alternatively, Mo and/or W wires can be used to achieve temperatures of up to about 3000° C. in an inert atmosphere, and induction heating or graphite resistance heating can be employed to achieve temperatures of up to about 3500° C. in an inert atmosphere. In order to achieve different temperatures within the primary and secondary heating zones 60 and 66, it should be apparent that the heating elements 68 and 70 must be separately set and controlled, which can be achieved through the use of any suitable type of temperature controller (not shown) known in the art. This aspect of the invention also provides the ability to accommodate castings of different structures/alloys without necessitating any changes to the apparatus 50, with the result that the apparatus 50 can be significantly more versatile than conventional Bridgman furnaces.

From the above, it should be appreciated that the overall sequence of the unidirectional solidification process performed with the apparatus 50 can be similar to the sequence of FIGS. 1 and 2 and, for that matter, unidirectional solidification processes performed with other traditional Bridgman furnaces. The ceramic mold 52 is preferably preheated and a master heat, which may be first remelted in an ampoule, is then poured into the mold cavity 54 at a desired temperature (superheat). At this point, the temperature of the melt within the mold cavity 54 is preferably allowed to stabilize. The length and sufficiency of this stabilization period can be determined through direct measurements using thermocouples or through a computer simulation. Once adequately stabilized, a translation system (not shown) of any suitable design is operated to translate the mold 52 from the secondary heating zone 66, through the primary heating zone 60 and the insulation zone 62, and then into the cooling zone 64 at an appropriate rate that will effect the desired columnar crystalline growth of the casting. This translation movement can be the result of a downward motion of the mold 52, an upward motion of the apparatus 50, or a combination of both.

Because the molten alloy within the secondary heating zone 66 contains both solid and liquid phases, it is important to note that the primary heating zone 60 serves to remelt the solids so that the material entering the insulation zone 62 is entirely liquid (molten) phase. Furthermore, the selection of temperature within the secondary heating zone 66 will determine the relative amounts of solid and liquid phases. Considering the solidification shrinkage and feeding requirement in the mushy zone of the alloy, the feeding path from the riser 58 to the insulation zone 62 must remain open, evidencing that the temperature within the secondary heating zone 66 cannot be too close to the solidus temperature. On the other hand, the liquid transported to feed the mushy zone shrinkage should have the same composition as the master heat, which indicates that the temperature within the secondary heating zone 66 should be close to the liquidus temperature. Such a scenario is depicted in FIG. 3(*b*), in which the temperature within the secondary heating zone 66 is slightly below the liquidus temperature of the alloy, with the result that there is small amount of solid crystals within the molten alloy located in the secondary heating zone 66. The actual amount of solid phase will depend on details of the phase diagram for the alloy and the set temperature ($T_{SHZ}$) of the secondary heating zone 66. In any event, because the solid crystals are remelted within the primary heating zone 60, there is no concern of new grain grown from the solid crystals.

In view of the above, it can be appreciated that a preferred aspect of the invention is the ability of the apparatus 50 and directional solidification processes carried out with the apparatus 50 to provide an appropriately high temperature within the molten alloy 56 immediately adjacent the insulation zone 62 to achieve a sufficiently high thermal gradient between the primary heating zone 60 and cooling zone 64 of the apparatus 50 to yield a desired small dendrite arm spacings for the casting. Simultaneously, the secondary heating zone 66 is defined and separated from the insulation and cooling zones 62 and 64 by the primary heating zone 60, so that the temperature of the molten alloy 56 within the secondary heating zone 66 is lower than in the primary heating zone 60. In this manner, in comparison with traditional Bridgman furnaces, the detrimental effects resulting from extended contact between the molten alloy 56 and the mold 52 (and any core within the mold 52) can be significantly mitigated. In particular, surface reactions between the molten alloy 56 and the mold 52 (and optional cores) can be significantly reduced because the kinetics of the reactions that occur between reactive elements within the molten alloy 56 and the material of the mold 52 (and optional cores) are exponentially dependent on temperature. Furthermore, relative movement and deformation of the mold 52 and any cores due to creep is also reduced since creep is also exponentially dependent on temperature. Moreover, the strength of the mold 52 (and any cores) is greater at the lower temperature within the secondary heating zone 66, further resisting relative movement of the mold 52 and any cores due to deformation. As such, the present invention is able to promote the quality of a casting, in terms of improving its dimensional quality by reducing the tendency for core shift and mold creep, in terms of promoting surface quality by minimizing reactions between the molten alloy 56 and the mold 52 (and any cores), and in terms of enhancing internal metallurgical quality by reducing the primary arm spacing, which inhibits grain defects and assists in acquiring uniform distribution of strengthening phases, for example, gamma prime (γ') in nickel base superalloys.

Other potential benefits arise from the lower temperature within the secondary heating zone 66, which results in a higher density of the molten alloy 56 within the secondary heating zone 66, and may also improve the feeding capability of the molten alloy 56 and the internal soundness of the resulting casting. Finally, it should be noted that the inclusion of the secondary heating zone 66 does not degrade the thermal gradient achieved within the insulation zone 62 between the primary heating and cooling zones 60 and 64, and a desired thermal gradient can be achieved with potentially less power consumption than required by the prior art apparatus 10 of FIGS. 1 and 2.

While the invention has been described in terms of specific embodiments, it is apparent that other forms could be adopted by one skilled in the art. For example, the physical configuration of the apparatus 50 and castings formed therewith could differ from those shown. Therefore, the scope of the invention is to be limited only by the following claims.

The invention claimed is:

1. A method of casting an alloy, the method comprising:

providing a mold having a molten quantity of the alloy within a cavity of the mold, at least a portion of the mold being located within a secondary heating zone of an apparatus, the secondary heating zone causing the molten quantity of the alloy located within the secondary heating zone to be at a secondary heating temperature that is below yet sufficiently close to the liquidus temperature of the alloy so that the molten quantity of the alloy located within the secondary heating zone contains a liquid phase and a minor amount of a solid phase;

causing relative movement between the mold and the apparatus so that the mold is translated from the secondary heating zone through a primary heating zone of the apparatus, the primary heating zone heating the molten quantity of the alloy located within the primary heating zone to a primary heating temperature above the liquidus temperature of the alloy, melting the solid phase within the molten quantity of the alloy, and thereby causing the molten quantity of the alloy located within the primary heating zone to contain only liquid phase;

causing relative movement between the mold and the apparatus so that the mold is translated from the primary heating zone through an insulation zone of the apparatus and into a cooling zone of the apparatus, the insulation zone creating a thermal gradient within the molten quantity of the alloy located within the insulation zone to cause unidirectional solidification of the molten quantity of the alloy entering the cooling zone; and then cooling the mold to produce a unidirectionally-solidified casting and a columnar crystal structure therein.

2. The method according to claim 1, wherein the apparatus comprises at least one primary heating element associated with the primary heating zone and adapted to heat the primary heating zone, and at least one secondary heating element associated with the secondary heating zone and adapted to heat to the secondary heating zone, the method further comprising individually controlling the primary and secondary heating elements.

3. The method according to claim 2, wherein the primary and secondary heating elements are controlled so that the secondary heating temperature is below but within a few degrees centigrade of the liquidus temperature of the alloy.

4. The method according to claim 1, wherein the alloy contains at least one element chosen from the group consisting of yttrium, zirconium, hafnium, tantalum, tungsten, rhenium, and titanium.

5. The method according to claim 1, wherein the alloy is a nickel-base, cobalt-base or iron-base superalloy, and the unidirectionally-solidified casting is a component of a gas turbine.

* * * * *